US005131132A

United States Patent [19]

Kindmann et al.

[11] Patent Number: 5,131,132

[45] Date of Patent: Jul. 21, 1992

[54] METHOD FOR ACCURATELY POSITIONING AND MOUNTING OF COMPONENT TO BE CONNECTED

[75] Inventors: Rolf Kindmann, Lunen; Hans J. Niebuhr, Iserlohn, both of Fed. Rep. of Germany

[73] Assignee: Thyssen Industri Age, Essen, Fed. Rep. of Germany

[21] Appl. No.: 652,291

[22] Filed: Feb. 4, 1991

Related U.S. Application Data

[63] Continuation of Ser. No. 321,575, Mar. 9, 1989, abandoned.

[30] Foreign Application Priority Data

Mar. 26, 1988 [DE] Fed. Rep. of Germany ..... 3810326

[51] Int. Cl.[5] ..... B23P 19/02

[52] U.S. Cl. ..... 29/525; 29/525.1; 104/124

[58] Field of Search ..... 29/404, 407, 525, 525.1; 104/106, 124, 281; 228/140

[56] References Cited

U.S. PATENT DOCUMENTS

| | | | |
|---|---|---|---|
| 3,034,611 | 5/1962 | Zenzic | 29/525 |
| 3,039,401 | 6/1962 | Bishop | 104/106 X |
| 3,118,217 | 1/1964 | Gardner | 29/525 |
| 3,631,807 | 1/1972 | Cherto | 104/124 X |
| 4,064,808 | 12/1977 | Nakamura et al. | 104/281 X |
| 4,087,896 | 5/1978 | Salter | 29/525 X |
| 4,620,358 | 11/1986 | Miller et al. | 104/281 X |
| 4,696,235 | 9/1987 | Wagner | 104/124 |
| 4,698,895 | 10/1987 | Miller et al. | 104/281 X |

FOREIGN PATENT DOCUMENTS 966127 7/1980 U.S.S.R. .

*Primary Examiner*—Mark Rosenbaum
*Assistant Examiner*—Frances Chin
*Attorney, Agent, or Firm*—McGlew & Tuttle

[57] ABSTRACT

A high degree of accuracy with regard to the location of a line such as a rail line is effected and a rigid, force-receiving connection with regard to a supporting structure and the precisely positioned mounting of components to be connected thereto at predetermined connection sites on a carrying structure particularly for magnetic cushion trains. Adjustable bolt connections have proven to be very awkward to mount and have therefore been replaced by computer controlled machining of connection elements for the components to be connected and which are fixedly connected to the track structure. The machining and also the mounting of the components to be connected is simplified by determining the desired position for the connection elements with regard to the connection sites. The connection elements are provided with spacers sized to guarantee their desired position with regard to the connection sites and by bolt elements screwed to the track standards at the respective connection sites.

19 Claims, 8 Drawing Sheets

METHOD FOR ACCURATELY POSITIONING AND MOUNTING OF COMPONENT TO BE CONNECTED

This is a file wrapper continuation application of U.S. Ser. No. 321,575 filed Mar. 9, 1989 now abandoned.

FIELD AND BACKGROUND OF THE INVENTION

The invention relates particularly to a process and apparatus for the accurate positioning and mounting of components to be connected at predetermined connection sites in the supporting structure of tracks for magnetic cushion trains. Connection elements in track supports are arranged in connection sites and dimensioned so that they can transfer the forces and moments occurring to the supporting structure. Once a track support is finished, the positions desired for the components to be connected are determined by measuring the support with regard to the location of the line.

During the development of a high-speed magnetic cushion train in the past years, from the planning stages to the application stage, magnetic cushion train tracks for the demonstration plant to the IVA 1979 in Hamburg and for the Transrapid Emsland pilot plant were executed and tested in operation. A high degree of accuracy is demanded in the positioning of the essential components of the tracks, taking into account the location of the line and also the loads working on the supports due to (magnetic levitation), driving, accelerating, braking, delevitating and dropping of the vehicle, which are to be received with a minimum of distortion.

The adjustment of the distance between the essential components and their position in space with regard to the location of the line by means of adjustable screw connections are known to some degree. The components to be connected are screwed in place once the track is erected at the location, and the setting is effected by means of measuring and adjusting the bolts, often at a considerable height and under difficult conditions. Unfavorable weather can disrupt the work considerably, and in winter the construction may even be discontinued completely.

This complex process was replaced by the process according to German patent 34 04 061 cited above. Herein the various track supports are equipped with the components to be connected precisely and without adjustment on location prior to their erection. They can be fixed at the respective storing place, e.g. an assembly bay, where a computer-controlled machining device drills and countersinks the connection element fixedly connected to the track support so that the components to be connected can be mounted precisely with the help of spacers and bolts and without adjustment. However, this process requires relatively complicated and complex machining equipment for the precise machining of e.g. track supports with a length of 30 m. Also, the known track constructions in which the connection elements are fixedly connected to the track section are complex and e.g the mounting of laminated iron elements for windings is complicated. Apart from German patent 34 04 061 we know a steel track for magnetic cushion trains also from German patent 34 12 401. The column-shaped welded connection elements of these steel tracks have the additional problem that the distortion occurring during welding, which cannot be eliminated entirely, results in a relatively major deviation of the connection surfaces for the components to be connected from the desired position which can then no longer be corrected.

SUMMARY OF THE INVENTION

The invention provides a track for magnetic cushion vehicles, allowing for a computer-aided, adjustment-free mounting of the components to be connected with little expense or effort and a method of positioning and mounting of components.

According to the invention, the desired position of the connection elements on the connection sites is determined and the connection elements with bores and with spacers guaranteeing their desired position with regard to the connection sites are provided and the line located. Thereafter they are screwed to the track support at the connection sites. As the connection elements are screwed to the track supports and as they are not connected fixedly to them before their machining, it is no longer necessary to provide complex machining devices designed for the machining of complete track supports which provides the long track supports with exact bores taking into account all the relevant coordinates. Instead, the track is measured and the desired positions for the components to be connected are determined, then the various connection elements and spacers are machined accordingly and mounted on the connection sites on the track supports. The components to be connected can simply be screwed onto the connection elements without any adjustment. The track is built on location by mounting the completely equipped track sections. As the various connection elements are provided with spacers at the sites bored precisely according to the coordinates, the desired positions can be adhered to with little effort. The connection elements including the spacers can be machined by a stationary machining device. The mounting of the connection elements by means of spacers provides a large degree of flexibility with regard to the distance between the connection elements and the track support, and it is possible to make structural simplifications during the fastening of the connection elements and therefore of the components to be connected at the determined sites. The fastening is very stable with regard to loads.

Due to the fact that the connection sites for the mounting of the connection elements are known before the track supports are measured with regard to the location of the line, and that the track supports are e.g. equipped with bolts with threaded bores already during their manufacturing the exact position of the connection sites including the position of the plane are at hand during the measuring for the determination of the desired position of the connection elements.

The connection sites on the track support are advantageously provided under the sheet metal cover in particular when the components to be connected to be fixed are long stator units for magnetic windings, which are to be fastened on a track support with a sheet metal cover. Despite the high degree of precision required with regard to the distance between the bottom side of the stator unit and the upside of the sheet metal cover and despite the impact of all the forces originating in the vehicle due to carrying, acceleration and braking, this simple manufacturing process fulfills all the requirements. It has been proven that it is not necessary to have the continuous supports which are welded in longitudinal directions especially for the connection elements of the stator units, additionally reinforced by means of traverses according to the prior art. This kind of execution is complex with regard to functionary efficiency, also with regard to precision and difficulty of mounting.

Advantageously the spacers of the various connection elements are machined by means of computer control according to the desired values, the machining being executed by a stationary machining device which is fed automatically with the connection elements or their spacers.

Due to the fact that the connection elements are drilled according to the connection sites already determined it is guaranteed that the exact position of the connection elements corresponds to the coordinates with regard to the horizontal plane without necessitating further machining of the finished support.

The components to be connected are first screwed to the connection elements, and then the connection elements together with the equipment parts are mounted to the respective connection sites of the track support which thus provides a considerable simplification of the mounting. This is true in particular for the mounting of the stator units which are relatively difficult to handle and whose connections with the connection elements are freely accessible before the mounting to the track support.

If, however, a machining device is on hand anyway, which can provide exact bores and countersinking for the connection elements with regard to all coordinates, it is also possible to machine the connection sites for the connection elements on the track support and to produce uniform connection elements. In this embodiment of the invention advantage is taken of an easier mounting of the components to be connected to the connection elements and of the simplified suspension of the connection elements.

The adjustment of the length desired for the spacers is simple because the spacers are tubes surrounding the connection bolts between the connection sites and the connection elements.

The tubes can be machined with the help of computer control according to their future location.

Another, simpler solution is to store tubes of various length and to choose them according to the requirements. This, too, can be automated.

The connection sites ca be executed in various ways.

If disc-like elements, which can have any shape are welded to the bottom side of the sheet metal cover of the track support, the supporting force is led reliably into the support and a simple option for the screw connection of the connection element is created. The machining of the connection site, drilling, thread-cutting and the preparation of the contact surface for the spacer can take place either before the welding of the disc-like elements or afterwards, in particular if a machining device is at hand.

A particularly stable, torsion-free kind of connection is achieved by fastening bolts, round steel bars or steel cubes provided with threaded engagement to the bottom side of the sheet metal cover and the connection elements with respectively short spacers are threaded in the supports.

An advantageous process is the connection of threaded bolts by sending a strong rush of current through the threaded bolt and the sheet metal cover and an aluminum ball which is located between the threaded bolt and the sheet metal cover, leading to an instantaneous welded connection of the parts. It is, of course, also possible to connect the bolts, round steel bars or steel cubes by means of any other welding method.

Particularly lightweight masses are to be handled when the connection elements are screwed on if the spacers are welded to the bottom side of the sheet metal cover of the track support and the connection elements are frictionally connected with the spacers by means of bolts passing through from above.

If the sheet metal cover of the track support is sufficiently thick, it is also possible to cut bores and effect threading into the track support itself and to screw the connection elements with the welded-on spacers to it. Due to the welding of the connection elements with the spacers stability is increased. No special connection elements are required of the track support itself.

Also, the connection elements and the spacers can be welded together for an easier mounting, the U-shaped element is then screwed on from above through the sheet metal cover of the track support by passing-though bores.

It is also possible to provide the connection sites for the spacers in a space-filling piece of sheet metal arranged between a lateral guide rail and a sheet metal web of the track supports or on traverses which are welded to the lateral guide rail and to the sheet metal web, or to a piece of sheet metal which is positioned horizontally and which connects the lateral guide rail and the sheet metal web. These track support structures are particularly resistant to lateral transverse forces working on the lateral guide rail and the latter execution is particularly resistant to corrosion because of the closed box it forms.

Accordingly, it is an object of the invention to provide a process for the accurate positioning and mounting of components which are to be connected at predetermined connection sites to a supporting structure of tracks for magnetic cushion trains and which comprises arranging connection elements in track supporting structures which are arranged in connection sites which are dimensioned so that they transfer the forces and moments to the supporting structure and once a track supporting structure is finished determining the positions desired for the components to be connected by measuring the supporting structure and then fixing the desired positions of the connection elements with regard to connection sites and applying a spacer to the connection elements which has been sized in accordance with the desired position of the elements with regard to the connection site and threadably engaging a threaded bolt through the connection element and the spaces to the track at the respective connection site.

A further object of the invention is to provide a support structure particularly for rail structures which comprises a connection site with a connection element having at least one bore therethrough and a spacer member of a selected length with at least one end secured to one of the connection element and the connection site and a threaded bolt member extending through the other of the connection element and connection site.

A further object of the invention is to provide a support structure particularly for rails which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENTS

Figure 1:
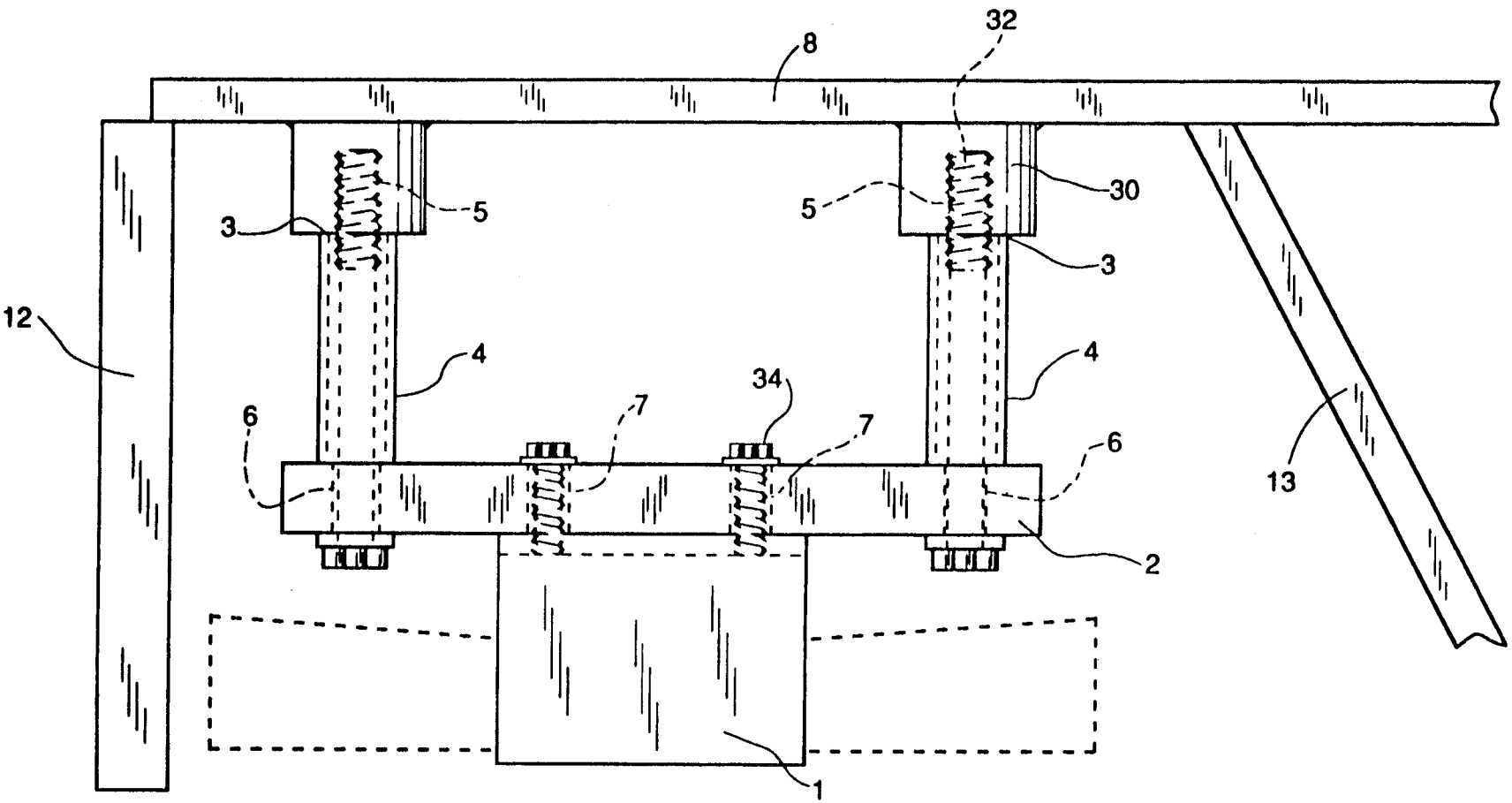
FIG. 1 is a partial vertical cross sectional view of a track support, and in particular of an outer left section with connection sites, connection elements and a long stator unit as a component to be connected.

Referring to the drawings in particular, the invention embodied therein in FIG. 1 comprises a support structure particularly for sheet metal cover, or rail, 8 which are supported on a lateral side rail 12 and which includes disc elements 30 which provide connection sites 3 through which a connection element 2 is to be secured at a selected spacing therefrom. In accordance with the invention, the connection element 2 has at least one bore therethrough 6 each bore being associated with a spacer member 4 of a selected length which has at least one end secured to one of either the connection element 2 or the connection site 3 of the disc 30. A threaded bolt 32 extends through the other of the connection element 2 or the connection site 3 and it is in threadable engagement with the disc element 30 defining the connection site 3 and also extends through the spacer 4.

FIG. 1 shows the exactly positioned mounting of a component to be connected, a long stator unit of a magnetic cushion train, to a track support . The connection elements 2 are arranged on the connection sites 3 and they are dimensioned so that they can transfer the forces and moments of the vehicle working on the components to be connected 1 to the supporting structure. Once the production of a track support is finished, it is measured with regard to the location of the line and the desired positions of the components to be connected 1 are determined. The connection elements 2 are drilled and equipped with spacers 4 so that the desired positions of the connection elements 2 are maintained with regard to the connection sites 3 and the location of the line and are screwed together with the track standards on the connection sites 3. Herein, the length of the spacers 4 is determined by means of the data obtained from the measuring of the standard which determine its actual shape and the spacers 4 are machined accordingly. Discs 30 which are sufficiently strong for the reception of the threaded bore 5 for the connection bodies such as a bolt 32 to be screwed on are welded to the connection sites 3. The discs 30 are provided with threaded bores 5 before the measuring. In the horizontal direction, i.e. in the lateral direction and the length direction of the track support or standard, deviations from the exact position desired for the long stator unit 1 are avoided by drilling the bores 6 in the connection element 2 for the mounting of said connection element 2 according to the position of the threaded bores 5 in the discs 30 at the connection sites 3. Thus the connection element 2 is positioned exactly also with regard to the length and the lateral directions and the desired position of the long stator unit 1 is achieved when it is screwed on symmetrically. It is, of course, also possible to form the bores 6 in the connection element 2 symmetrically and to form the bores 7 for the stator unit 1 in alignment with the desired values. During the assembly, the long stator unit 1 is screwed to the connection element 2 first, bolts 34 being freely accessible. Then the connection element 2 with the stator unit 1 is screwed to the track at the connection site 3. The windings on the long stator unit 1, shown in a broken line, is mounted only once the track is erected on location.

Figure 2:
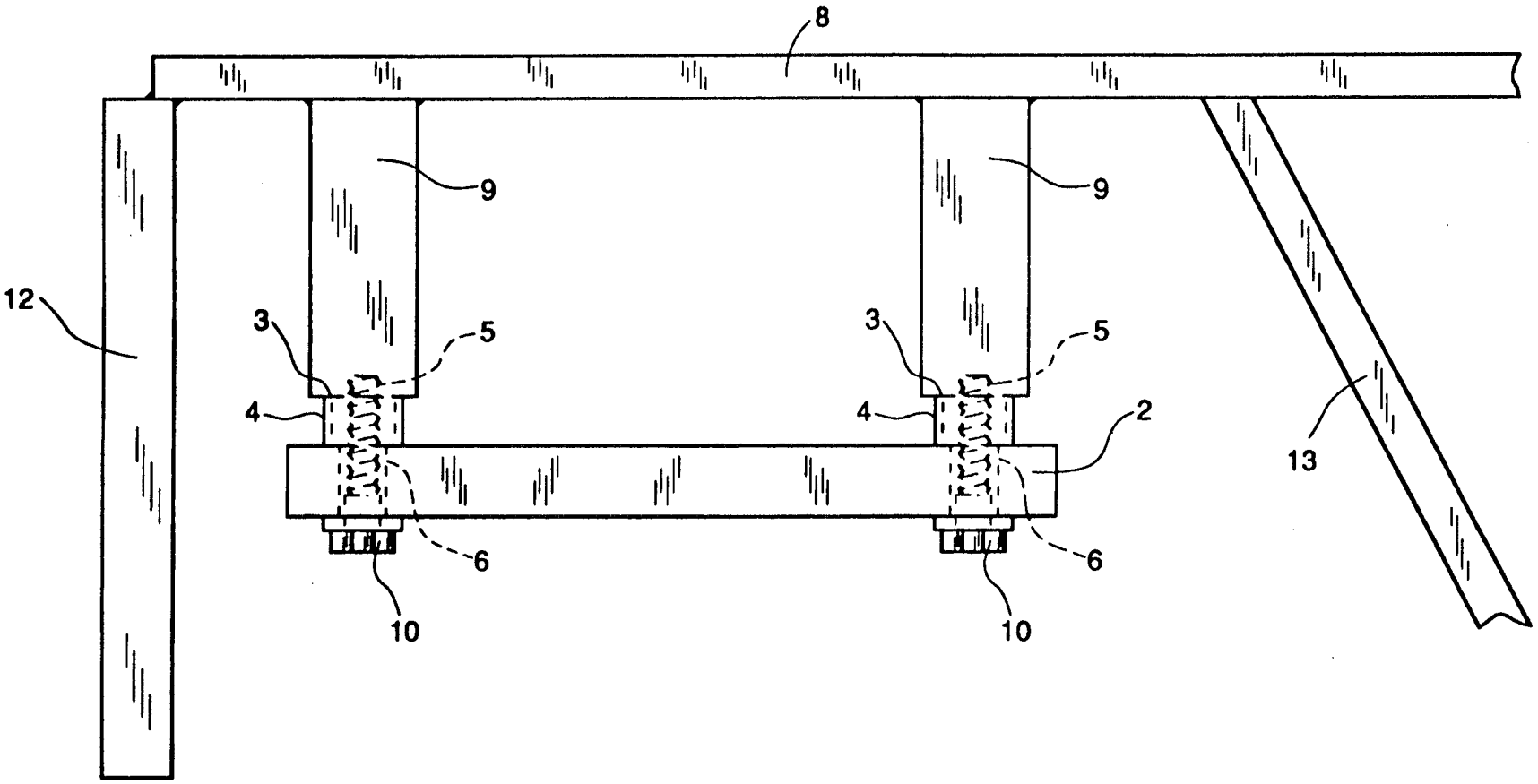
FIGS. 2-9 are similar views of other embodiments of the connection sites on the track support and of the connection elements.

In FIG. 2 internally threaded bolts or receiving members 9 are fastened to the sheet metal cover 8 and the connection elements 2 are screwed together with the spacers 4, which are short in this case. The fastening of the threaded bolts 9 is effected by means of spot-welding or arc welding wherein a strong surge of current sent through the threaded bolt 9 and through an aluminum ball located between the threaded bolt and the sheet metal cover 8 and also through the sheet metal cover 8 while the threaded bolt is pressed on. The connection elements 2 with the spacers 4, which are short in this case, are screwed to the threaded bolts 9.

Figure 3:
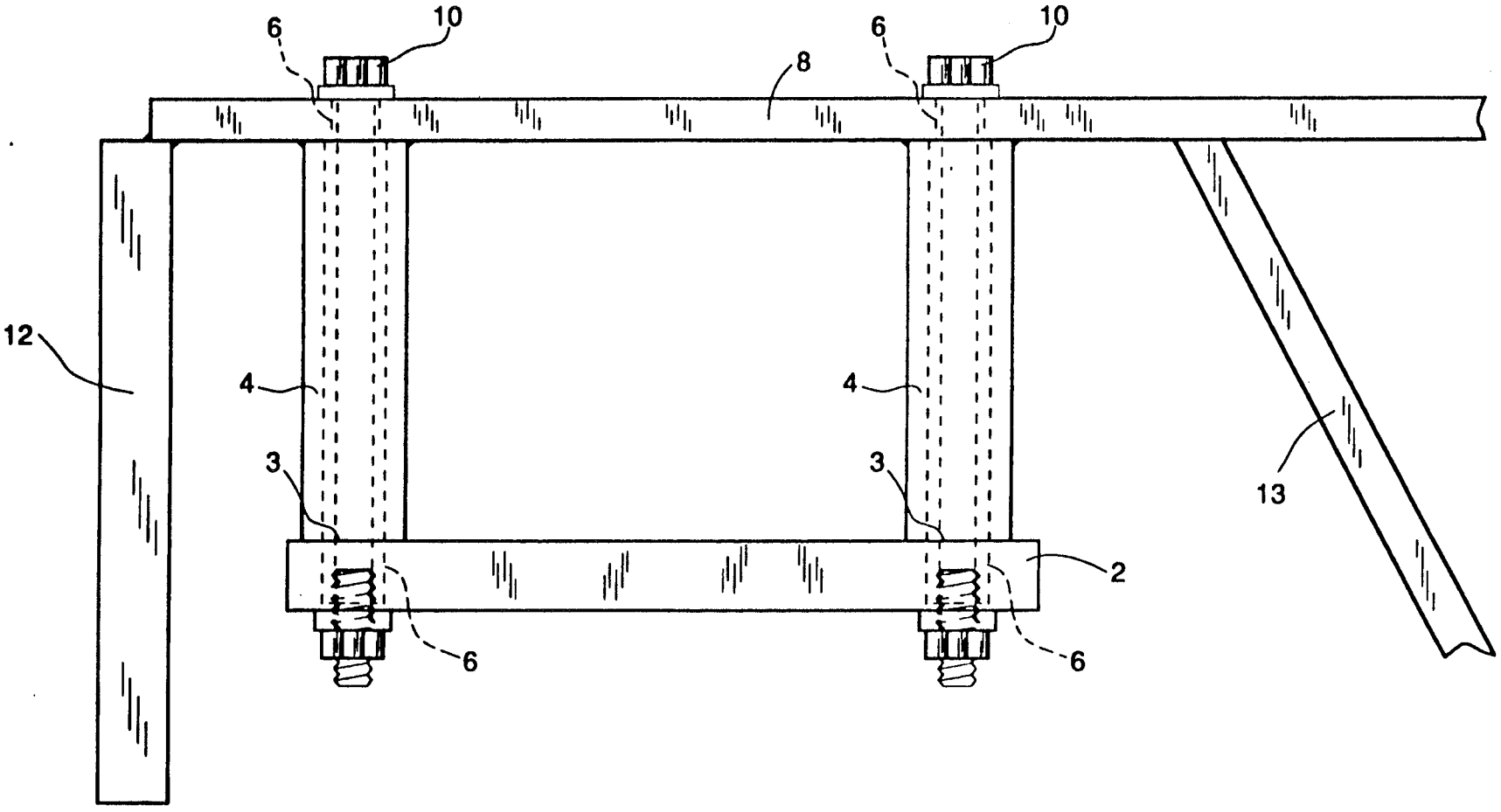

In FIG. 3 the length of the tube-shaped spacers 4 is adjusted according to their planned location and then they are welded to the sheet metal cover 8. Due to the fact that the bores were drilled exactly according to the coordinates, the connection elements 2 are screwed on in the correct position. The screws or bolts 10 penetrate the sheet metal cover 8 from above.

Figure 4:
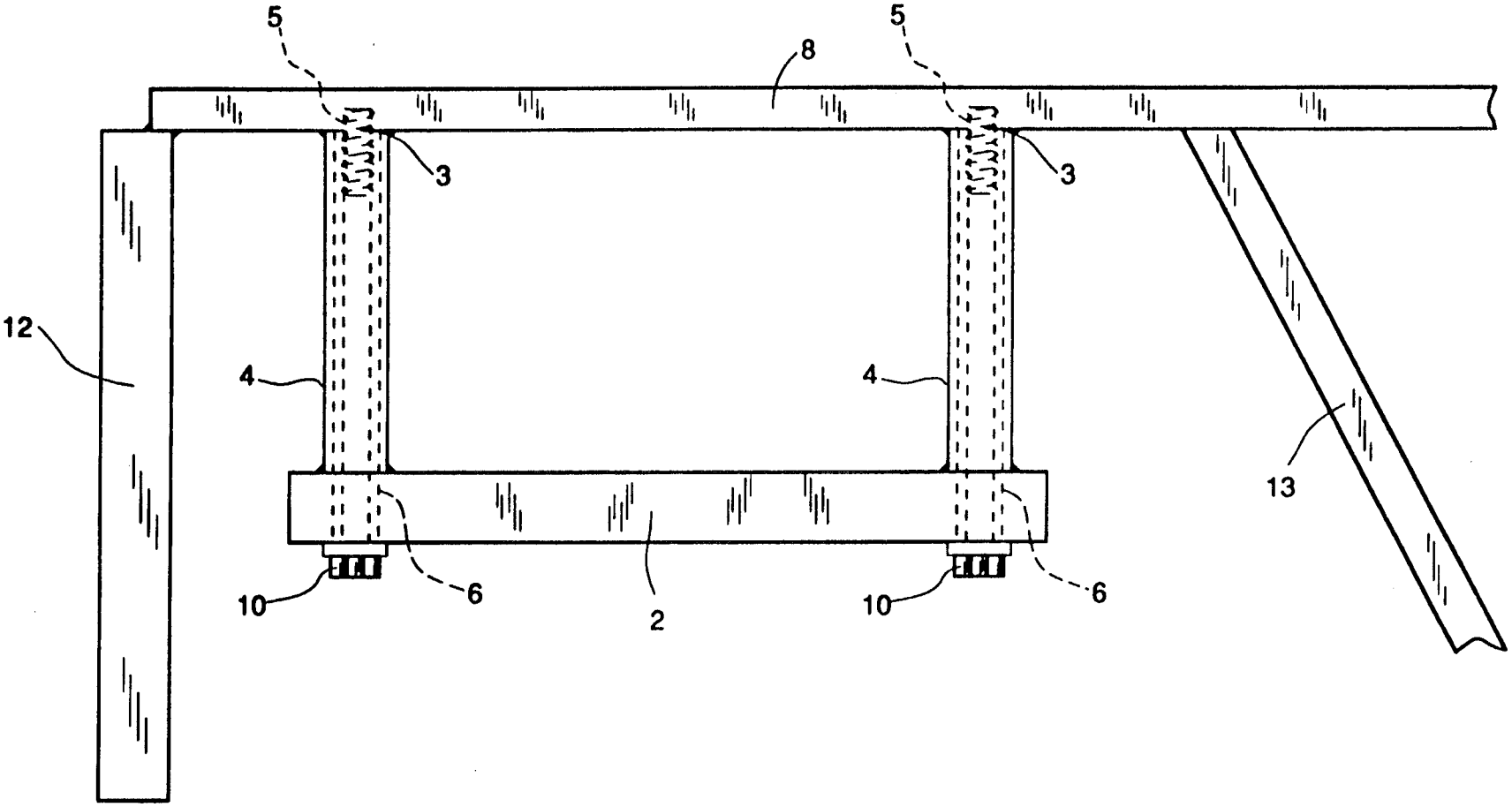

In FIG. 4 the connection sites 3 for the connection element 2 are arranged directly in the sheet metal cover 8. The sheet metal cover is reinforced for this purpose and has threaded bores for the mounting or screwing-on of the connection elements 2. The spacers 4 are welded to the connection elements 2 and have been machined to the correct length by milling before they were mounted to the sheet metal cover 8.

Figure 5:
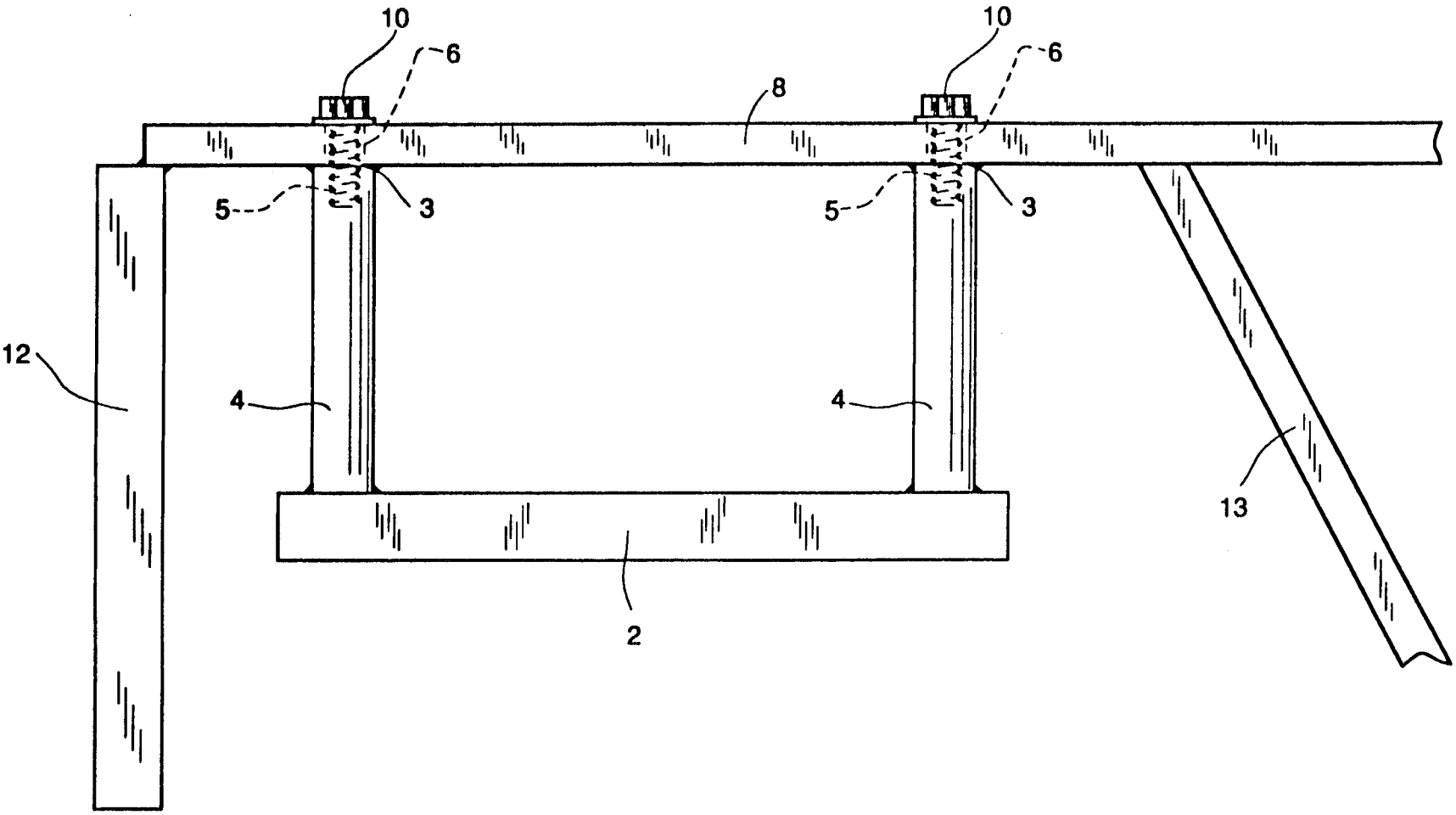

In FIG. 5 the spacers 4 machined for length are welded to the connection elements 2 and are screwed to the sheet metal cover 8 by bolts 10 penetrating the sheet metal cover 8 from above.

Figure 6:
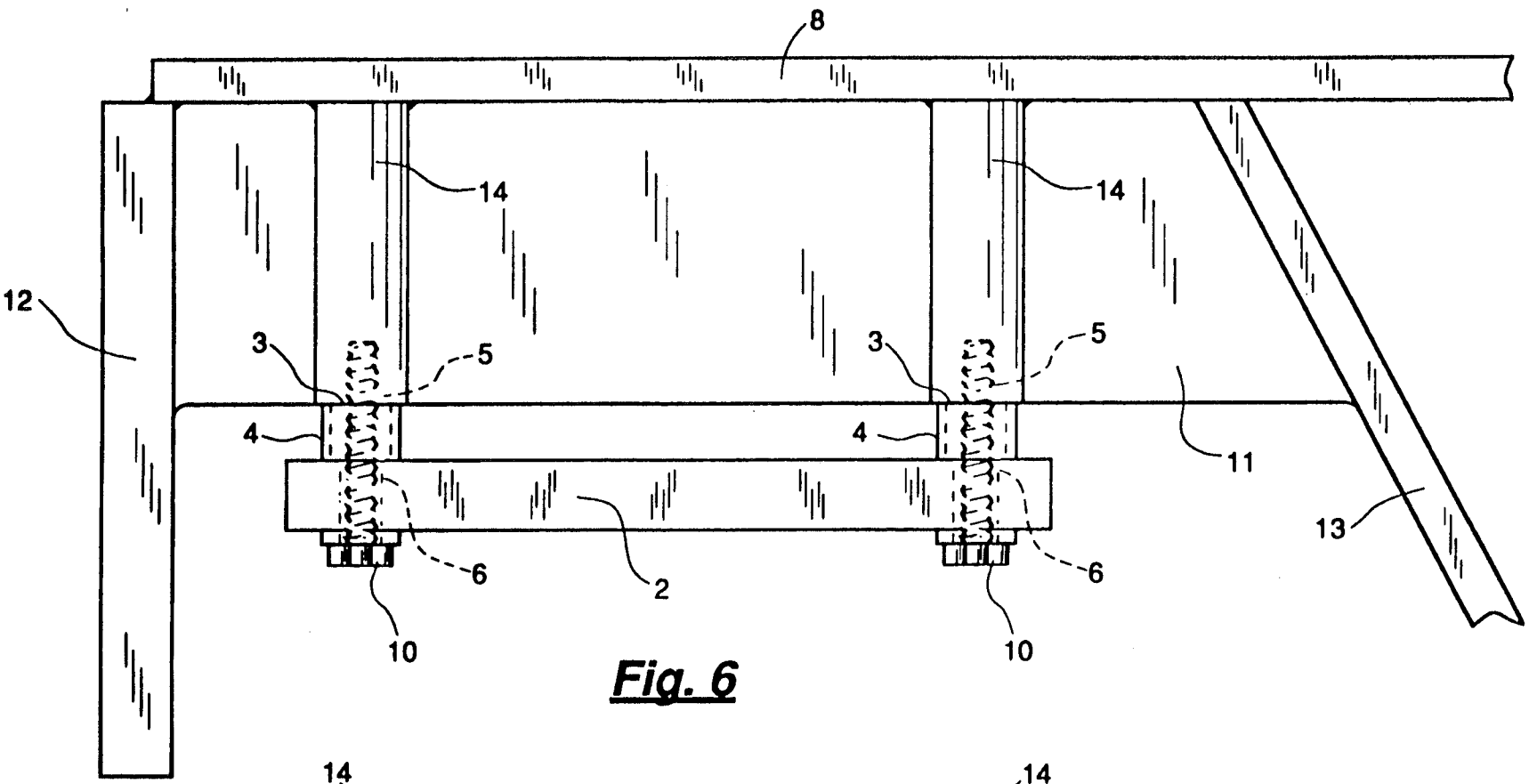
Figure 7:
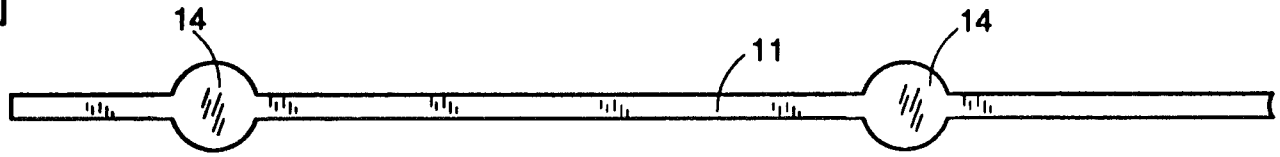

In FIG. 6 and 7 pieces of sheet metal 11 extending in transverse direction with regard to the track are welded between the lateral guide rail 12 and the sheet metal web 13. The pieces of sheet metal 11 are provided with a reinforced section 14 comprising the threading for the bolts 5 of the connection elements 2. The connection elements 2 and their spacers 4, which are short in this case, are screwed to the reinforced sections 14.

Figure 8:
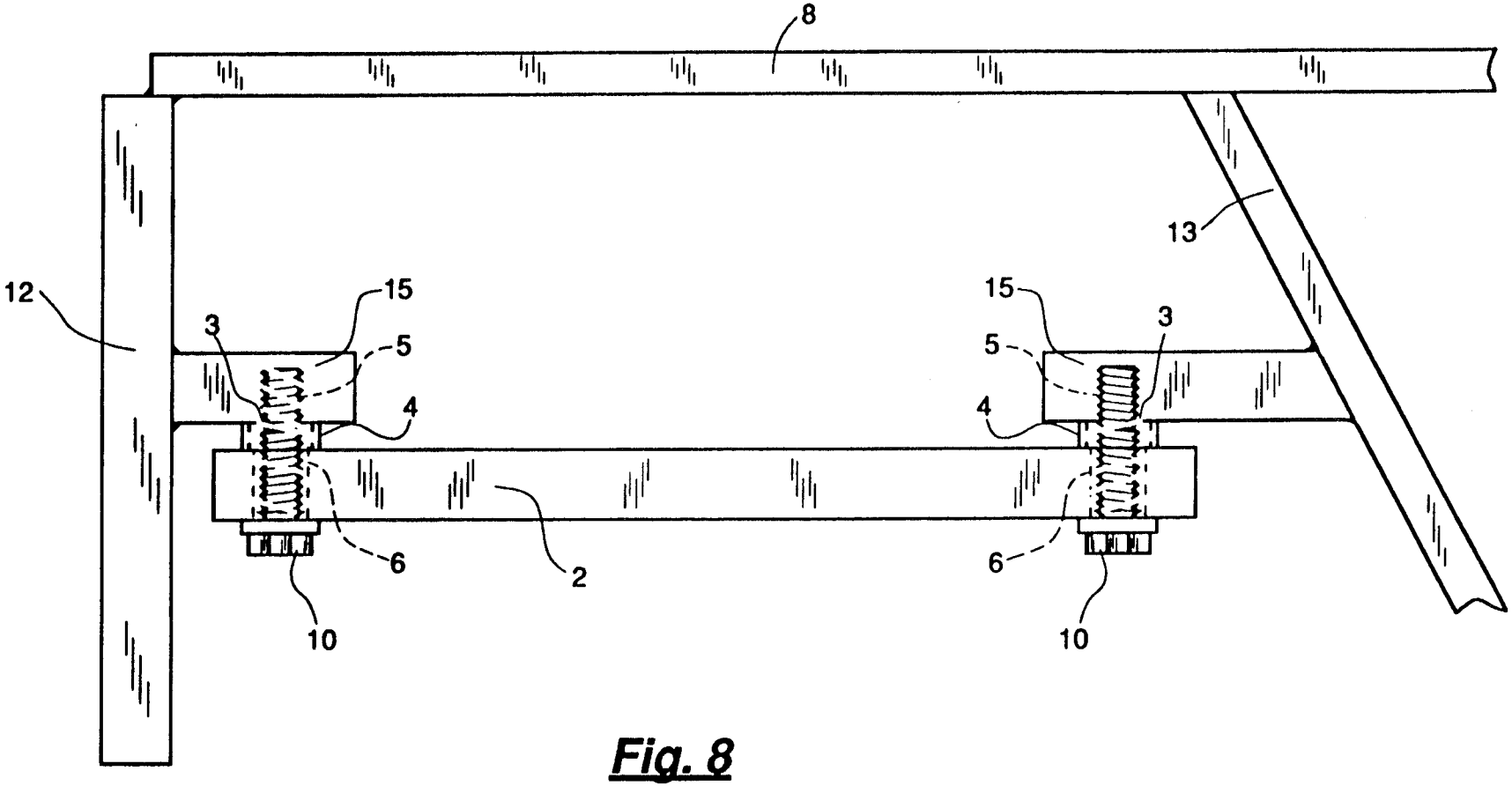

In FIG. 8 one piece of sheet metal 15 each extending in longitudinal direction is welded to the lateral guide rail 12 and the sheet metal web 13 as a bracket. The pieces of sheet metal 15 have a threaded bore 6 for bolt 5 to which the connection element 2 with the machined spacers 4 is screwed.

Figure 9:
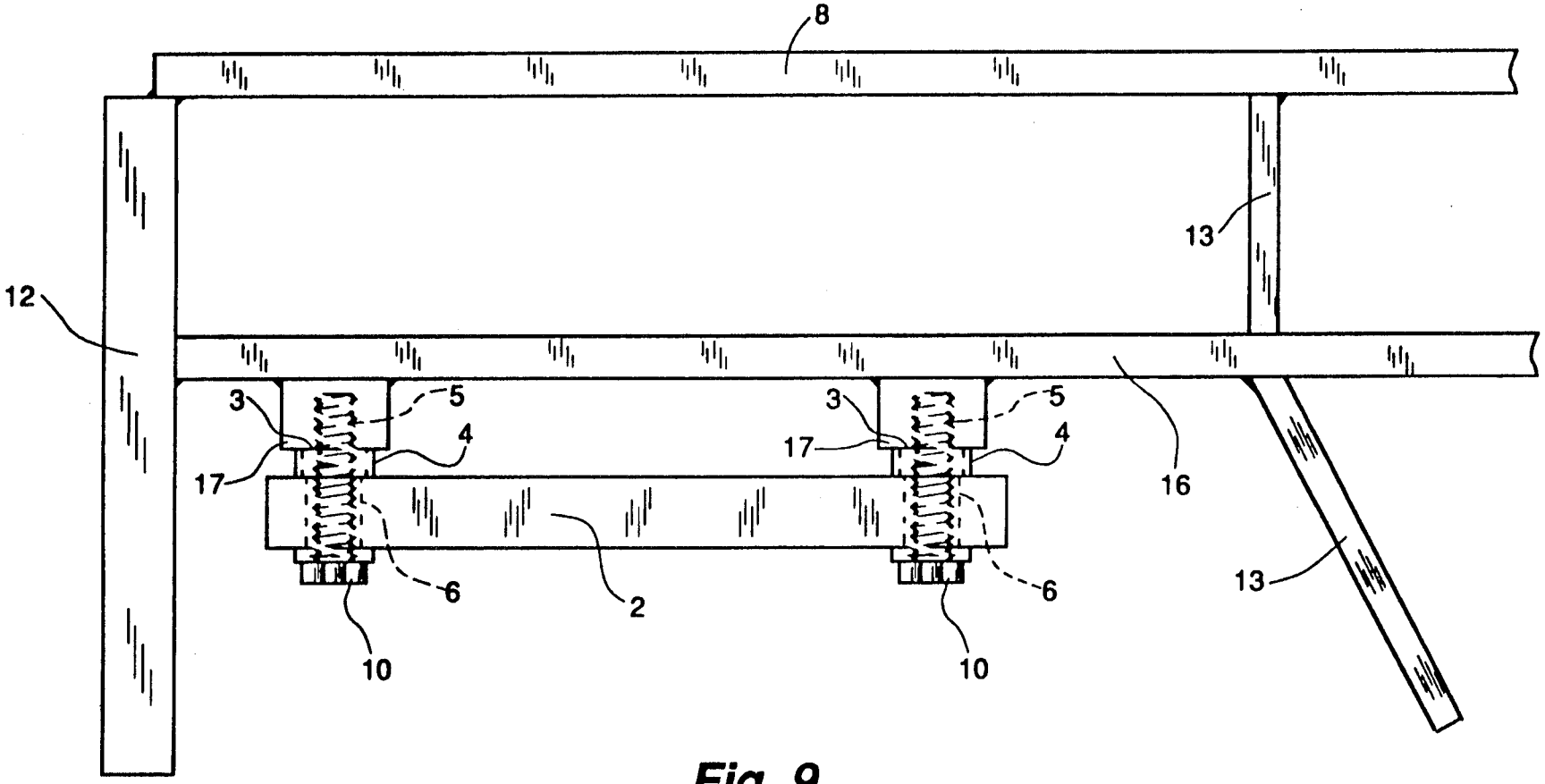

In FIG. 9 metal discs 17 are welded to the bottom of a continuous piece of sheet metal 16 arranged in longitudinal direction, to whose threaded bores 5 the connection element 2 is screwed, machined spacers 4 being inserted between the metal discs 17 and the connection element 2.

While specific embodiments of the invention have been shown and described in detail to illustrate the application of the principles of the invention, it will be understood that the invention may be embodied otherwise without departing from such principles.

What is claimed is:

1. A method for positioning and mounting a component to a track support structure, comprising the steps of:

defining a track location including providing a track support structure in a permanent position for track use;

determining a connection site along the track support structure at the connection site;

determining the proper position of the component form the track support structure;

measuring the distance from the connection site to the proper position of the component at said track location;

forming a spacer having a length for mounting the component in the determined proper position of the component based on the distance measured from said connection site;

fastening a connection element to the component; and fastening said connection element to said connection site with said spacer provided between said disk element and said connection element to accurately position said component with respect to said track support structure.

2. A process for the accurate positioning and mounting of a component to a track support structure comprising the steps of:

positioning the track support structure at a permanent final track location;

forming connection sites on said positioned track support structure;

covering the track support structure with a sheet metal cover;

determining the proper position of the component from the track support structure;

measuring the distance from one of said connection sites to said proper position of the component at said permanent final track location;

forming spacers having a length for mounting the component in said determined proper position of the component, said length based on said distance measured from said connection sites to said determined proper distance of said component;

fastening connection elements to the component by bolting wherein said connection elements are attached to corresponding said connection sites by passing separate bolts through a bore in each end of said connection elements, passing said bolts through said spacers and threadedly engaging said bolts into an internally threaded bore in said connection sites and arranging said connection elements below said sheet metal cover secured thereto by said bolt;

fastening said connection elements to said connection sites with said spacer separating said connection elements from said connection sites causing the component to be accurately positioned and mounted, the component to be connected being formed by a stator unit for magnetic windings.

3. A process for the accurate positioning and mounting of a component to a track support structure comprising the steps of:

positioning the track support structure at a permanent final track location;

forming connection sites on said positioned track support structure;

determining the proper position of the component from said positioned track support structure;

measuring the distance from one of said connection sites to said proper position of the component at said permanent final track location;

forming spacers having a length for mounting the component in said determined proper position of the component, said length based on said distance measured from said connection sites to said determined proper distance of said component;

fastening connection elements to the component; and fastening said connection elements to said connection sites with said spacer separating said connection elements from said connection sites causing the component to be accurately positioned and mounted.

4. A process in accordance with claim 3 wherein:

the component is attached to said connection elements by bolting;

said connection elements are attached to said connection sites by passing separate bolts through a bore in each end of said connection elements;

passing said bolts through said spacers; and threadedly engaging said colts into an internally threaded bore in said connection sites.

5. A process according to claim 4, wherein the spacers are machined by computer control according to a desired spacing of said connection elements from said connection sites.

6. A process according to claim 4, wherein bores are spot drilled into a thick sheet-metal cover of the track support structure and then threaded thereto and wherein connection elements have spacers welded thereto through which said threaded bolts extend.

7. A process according to claim 3, wherein said spacers comprise tubes surrounding connection bolts extending through said connection elements.

8. A process according to claim 7, wherein the length of said spacer tube is machined computer-controlled to determine its precise length.

9. A process according to claim 7, wherein said tubes are chosen according to the desired size from a stock of various sizes.

10. A process according to claim 3, wherein said connection elements are secured to said connection sites by said threaded bolt extending through said connection elements.

11. A process according to claim 3, wherein said connection sites are provided with precise bores according to where said connection elements are to be located and spacers of equal length are screwed to said connection sites.

12. A process according to claim 3, wherein a bolt extends through said connection elements and is threaded into said connection site and including an internally threaded bolt fastened to a bottom side of a sheet metal cover.

13. A process according to claim 12, wherein said threaded bolt is connected to said sheet metal cover by applying a strong surge of current through said threaded bolt, through said connection elements and through said sheet metal cover as said threaded bolt is pressed on comprising said track structure.

14. A process according to claim 3, wherein said connection sites comprise a disc-shaped member welded to the bottom of a sheet metal cover comprising said track structure.

15. A process according to claim 3, wherein said spacers are welded to a bottom side of a sheet metal cover forming a portion of the track support structure, said connection elements being frictionally connected to said spacers by means of bolts passing through said connection elements.

16. A process according to claim 3, wherein said spacers are welded to said connection elements to form a U-shaped element are screwed on from above through bores in a sheet metal cover comprising said track support structure.

17. A process according to claim 3, wherein each of said connection sites includes a piece of sheet metal arranged to said track structure, said track structure including a lateral guide rail and a sheet metal web arranged in a plane defined by said connection sites.

18. A process according to claim 3, wherein said connection sites are provided on transverse elements forming said track structure which are welded to a lateral guide rail of said track structure.

19. A process according to claim 3, wherein said connection sites are provided on a piece of sheet metal forming said track structure which is positioned horizontally and which connects a lateral guide rail of said track structure with said piece of sheet metal.

* * * * *